US006982666B2

(12) United States Patent
Temes et al.

(10) Patent No.: US 6,982,666 B2
(45) Date of Patent: Jan. 3, 2006

(54) THREE-DIMENSIONAL SYNTHETIC APERTURE RADAR FOR MINE DETECTION AND OTHER USES

(75) Inventors: Clifford L. Temes, Alexandria, VA (US); John A. Pavco, Burke, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 620 days.

(21) Appl. No.: 09/876,137

(22) Filed: Jun. 8, 2001

(65) Prior Publication Data

US 2004/0118313 A1 Jun. 24, 2004

(51) Int. Cl.
*G01S 13/00* (2006.01)

(52) U.S. Cl. ..... 342/22; 342/25 R; 342/64; 342/179

(58) Field of Classification Search ..... 342/22, 342/25, 64, 179, 368, 459, 465; 244/137.4; 362/470; 343/705
See application file for complete search history.

(56) References Cited

U.S. PATENT DOCUMENTS 4,675,677 A * 6/1987 von Maydell et al. ..... 342/25
4,706,031 A * 11/1987 Michiguchi et al. ..... 324/337
4,797,680 A * 1/1989 Smethers, Jr. ..... 343/705
4,978,960 A * 12/1990 Newcomb et al. ..... 342/25 C
5,592,170 A 1/1997 Price et al.
5,673,050 A * 9/1997 Moussally et al. ..... 342/22
5,837,926 A 11/1998 Franklin (Continued)

OTHER PUBLICATIONS

Keigo Iizuka et al., "Detection of nonmetallic buried objects by a step frequency radar", proceedings of the IEEE, vol. 71, No. 2, Feb. 1983. pp. 276-279.*

(Continued)

*Primary Examiner*—Thomas H. Tarcza
*Assistant Examiner*—Isam Alsomiri
(74) *Attorney, Agent, or Firm*—John J. Krasek; Sally A. Ferrett

(57) ABSTRACT

A radar system for generating a three-dimensional image includes a radar transmitter which is operable to produce a radar signal of a frequency of at least three gigahertz. A plurality of radar receiving antennas from an antenna array. The antenna array is aerially translatable. For example, in one embodiment, the antenna array is disposed along the wings of an aircraft which, in operation, flies over the intended target area. A three-dimensional image is generated from a reflected radar signal returned from the surface of an object in response to the transmitted radar signal. The radar system may be incorporated into an aircraft and adapted to detect subsurface objects such as mines buried beneath the surface of the ground as the aircraft traverses over a target area.

32 Claims, 2 Drawing Sheets

U.S. PATENT DOCUMENTS

| | | | | | |
|---|---|---|---|---|---|
| 5,867,117 | A | * | 2/1999 | Gogineni et al. | 342/22 |
| 5,900,833 | A | * | 5/1999 | Sunlin et al. | 342/22 |
| 5,920,285 | A | | 7/1999 | Benjamin | |
| 5,936,233 | A | | 8/1999 | Nunnally | |
| 5,969,661 | A | | 10/1999 | Benjamin | |
| 5,974,881 | A | | 11/1999 | Donskoy et al. | |
| 6,133,869 | A | * | 10/2000 | McGill | 342/351 |
| 6,384,766 | B1 | * | 5/2002 | Ulander | 342/25 |
| 6,590,519 | B2 | * | 7/2003 | Miceli et al. | 342/22 |
| 6,626,078 | B2 | * | 9/2003 | Thornton | 89/1.13 |
| 2003/0076254 | A1 | * | 4/2003 | Witten | 342/22 |

OTHER PUBLICATIONS

Alan Langman et al., "Develpment of low cost SFCW ground penetrating radar", Geoscience and Remote Sensing Symposium, vol.: 4, May 27-31, 1996, pp.: 2020-2022 vol. 4.*

Sletten et al.; "An airborne, real aperture radar study of th Chesapeake Bay outfloe plume"; Journal of Geophysical Research (USA), vol. 104, pp. 1211-1222; Jan. 15, 1999.*

Taylor, J.D., "Ultra-Wideband Radar Technology", 2001, pp. 329-342, CRC Press.

* cited by examiner

THREE-DIMENSIONAL SYNTHETIC APERTURE RADAR FOR MINE DETECTION AND OTHER USES

BACKGROUND OF THE INVENTION

1. Field of the Invention

The present invention relates to a system and method for detecting objects under the surface of the ground, and in particular, to three-dimensional imaging to detect an underground target item such as a mine.

2. Background of the Invention

Buried mines on, e.g., a beachhead, are a major threat to amphibious landing forces and a severe obstacle to a rapid amphibious landing. Clearing mines prior to a full-scale landing is a slow and tedious process that requires manual location and neutralization of the individual mines. This process includes the use of heavy machinery to detonate anti-personnel mines while, at the same time, facing the threat of larger anti-tank mines.

Ground penetration radar systems using transistor generated short pulses have been in use for decades for geophysical applications. These systems can be relatively compact, approximately the size of a lawn mower, and are generally pulled along the ground with the radar signal directed downwardly into the ground.

Recently, airborne (e.g., from an aircraft) synthetic aperture radar (SAR) has also been used in mine detection. SARs typically are side-looking radar which produce a two-dimensional image of the earth's surface. In the past, SARs operated with bandwidth up to 500 mHz or 1 GHz resulting in range resolution of 6 inches.

In addition to aircraft-based radar systems, ground-based two-dimensional SAR imaging systems have been used to locate buried mines. These ground-based SAR systems use an impulse radar disposed on an elevated platform and operated in a side-looking mode.

One disadvantage with current radar-based mine detecting systems is that these systems tend to be limited to generating only a two-dimensional image rather than a three-dimensional image. A two-dimensional imaging system has limited capabilities with respect to the accuracy and precision by which the mine detection system operates when compared with that potentially available with three-dimensional imaging system.

An additional disadvantage with current SAR systems is that these systems produce an image of limited resolution. Since SARs have operated at bandwidths up to 1 GHz, SAR range resolution is limited to about six inches, as indicated above. Consequently, the six-inch imaging resolution reduces the applicability of SARs in buried mine imaging, detection and classification because mines tend to be 3 inches to a foot in diameter.

BRIEF SUMMARY OF THE INVENTION

In accordance with the present invention, an aerially disposed three-dimensional SAR system is provided which enables subsurface (i.e., underground) object detection. Such objects include, but are not limited to, mines. The three-dimensional SAR includes a radar transmitter and an array of receiving antennas which are aerially translatable, i.e., which are mounted on an aircraft so as to be transported with the aircraft. Three-dimensional SAR imaging is obtained from a reflected radar signal detected by the antenna array as the array traverses over a target area.

According to one aspect of the invention, a radar system includes an aircraft for detecting buried objects from the air, for overflying a target area of interest, a radar transmitter, carried by the aircraft, for producing a radar signal of a frequency or at least three gigahertz, a plurality of radar receiving antennas, carried by the aircraft and forming an antenna array, for receiving a reflected signal produced by reflection of said radar signal, and a processor for generating a three-dimensional image of said object from the reflected signal.

According to another aspect of the invention, a method is provided for detecting a subsurface object in a target area from an aircraft. The method includes transmitting a pulsed radar signal having a frequency of at least three gigahertz using a radar transmitter dispersed on the aircraft, receiving a return of the transmitted signal reflected by the subsurface object with a plurality of radar receiving antennas disposed on the aircraft and forming a receiving antenna array, and generating a three-dimensional image based on the received return of the transmitted signal.

An advantage of the present invention concerns the use of an aerial translatable three-dimensional synthetic aperture radar for the detection of buried objects such as mines.

An additional advantage of the present invention concerns enhanced image resolution compared with conventional SAR systems by implementing SAR using a radar signal having a frequency of at least three gigahertz.

Yet another advantage of the present invention concerns the use of various types of wide band radar signals such as impulse radar signals and frequency-stepped pulse compression radar signals.

Further features and advantages of the present invention will be set forth in, or apparent from, the detailed description of preferred embodiments thereof which follows.

BRIEF DESCRIPTION OF THE DRAWING

FIG. 1(*b*) is a perspective view of the radar system of FIG. 1(*a*)

DETAILED DESCRIPTION OF THE INVENTION

Figure 1A:
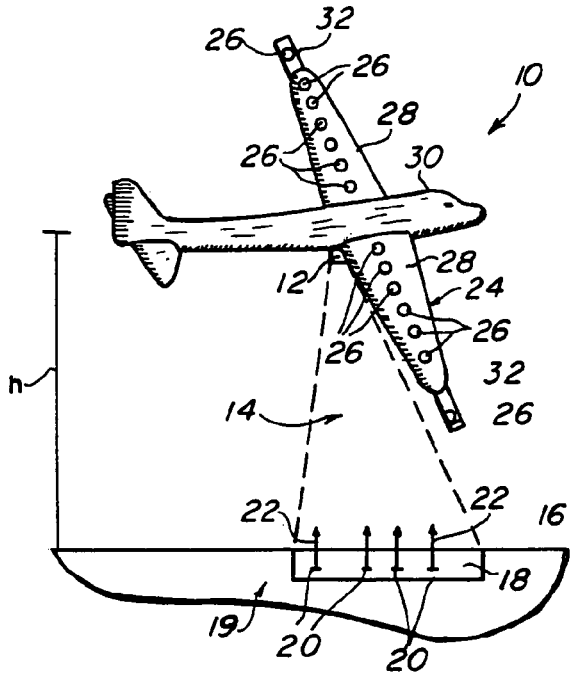
FIG. 1(*a*) is an elevational view of an aircraft-mounted radar system according to a preferred embodiment of the present invention, with the aircraft shown in a tilted position for illustrative purposes.
Figure 1B:
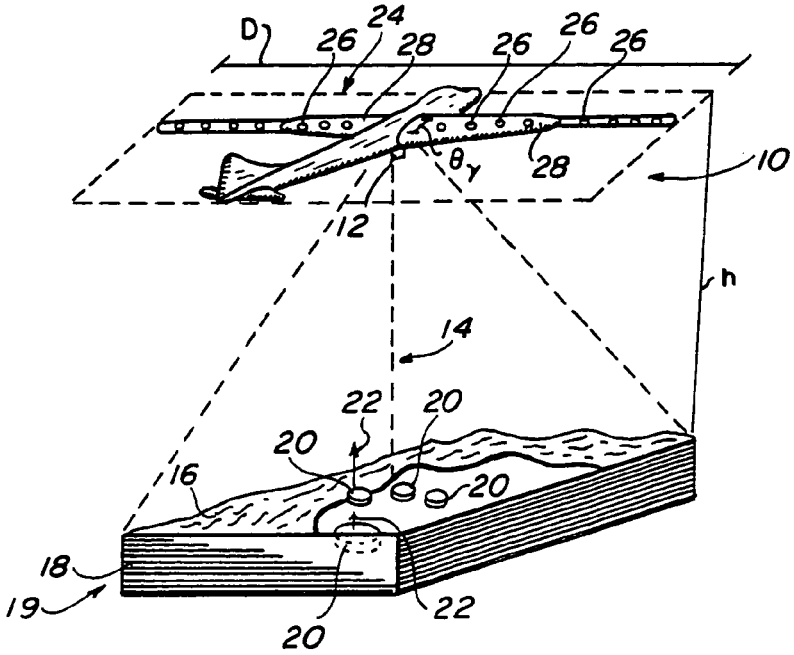

Referring now to the drawings, and in particular to FIGS. 1(*a*) and 1(*b*), illustratively depicted therein is radar system 10 according to the present invention. Radar system 10 includes radar transmitter 12 which generates radar signal 14 of at least three gigahertz, corresponding to the S-band and X-band carrier frequencies. Preferably, the frequency is within the range of three to ten gigahertz to provide good resolution with acceptable signal attenuation. However, higher frequencies can be used to provide enhanced resolution where signal attenuation is accommodated.

The radar signal 14 is directed towards the surface 16 of the underlying ground 18 of a target area denoted 19. Radar signal 14 penetrates surface 16 and reflected signals 22 are produced by the radar signal 14 reflecting off of the surface of buried objects indicated at 20.

An antenna array 24 is formed of a plurality of receiving antennas 26 which receive reflected signal 22. Receiving antennas 26 are disposed along wings 28 of an aircraft 30.

The real aperture, $a_r$ of antenna array 24 is defined by the diameter of the individual receiving antennas 26. A horizontal aperture for the radar system 10 is defined by the width D of the antenna array 24. The height of the aircraft 30 is indicated as h.

To enhance the horizontal aperture of the radar system, some of the receiving antenna 26 are located on extendible booms 32 located at the opposite ends of wings 28. As will be obvious to one of ordinary skill in the art, the lengths of the booms 32 may be extended or varied in order to produce larger or variable horizontal apertures as necessary.

Figure 2:
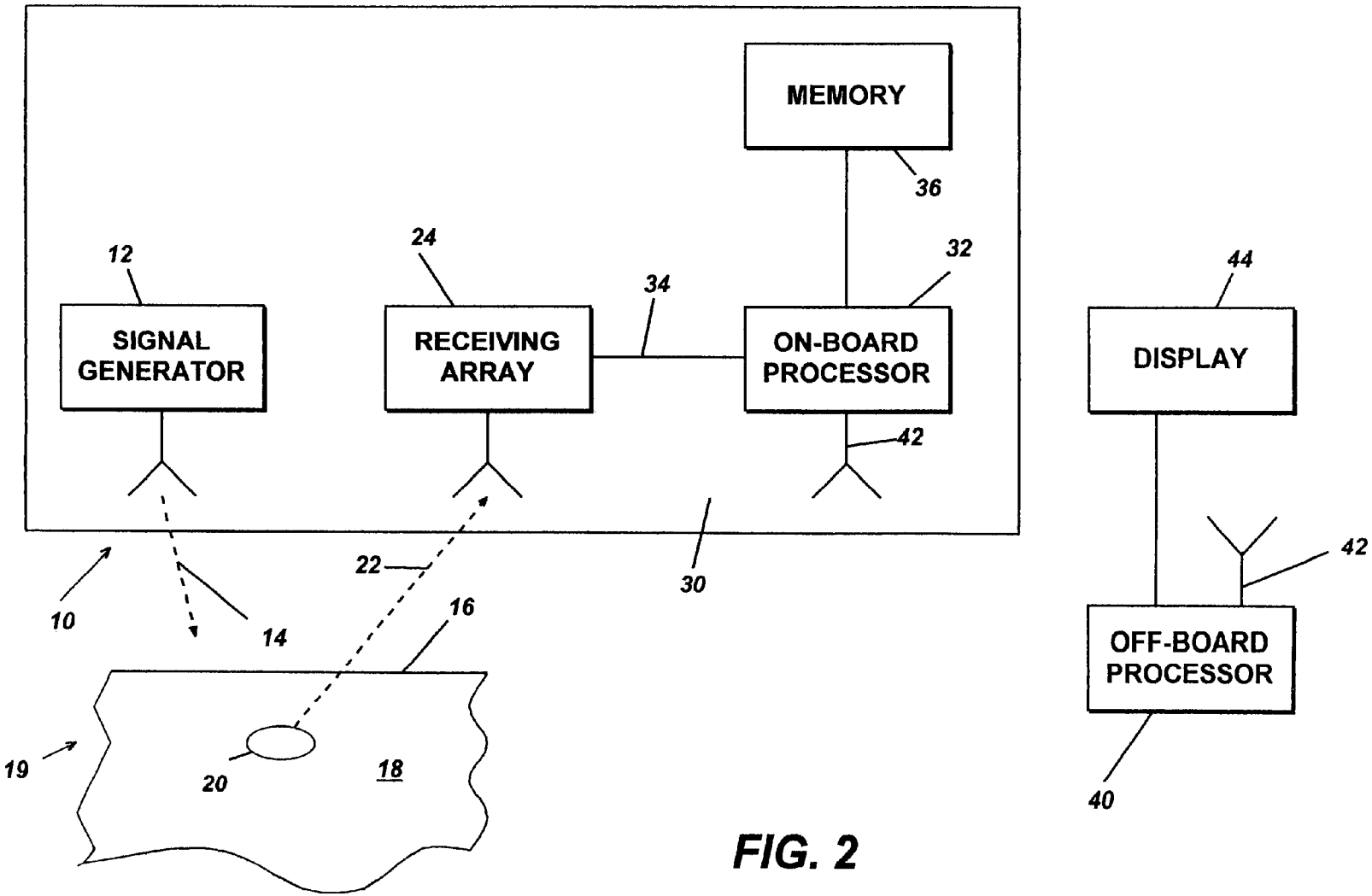
FIG. 2 is a schematic diagram, partially in block form, of the basic operation of the system of the invention.

To further aid in an understanding of the implementation of radar system 10, FIG. 2 provides a block diagram which schematically depicts the operation of radar system 10. As described above, during the operation thereof, radar transmitter 12 generates and directs radar signal 14 toward the surface 16 of ground area 18. The radar signal 14 is reflected off of the surface of a buried object 20 thereby forming reflected signal 22. A portion of reflected signal 22 is received by the antenna array 24.

When radar system 10 is deployed in mine detection, carrier frequencies above L-band yield depth penetration beneath the surface 16 while also providing attenuation of backscattering from material at depths greater than typical, standard mine deployment. Three-dimensional SAR imaging is achieved from radar system 10 by aerially traversing target area 19 while transmitting a radar signal 14 thereto and receiving a reflected signal 22 therefrom by means of receiving array 24.

Three-dimensional images may be generated from radar system 10 of varying resolution based on radar frequency, along track real receiver aperture dimension (a) cross track array aperture, and altitude h of aircraft 30. More specifically, three-dimensional imaging is obtained from reflected signal 22 from range resolution, along-track resolution, and cross-track resolution. The range resolution is obtained from reflected signal 22, independently of the height h of aircraft 30. The along-track resolution is obtained through standard SAR processing known in the art. The along-track resolution obtained by synthetic aperture processing is also independent of the height h of aircraft 30, but limited by the along-track real aperture size $a_r$. Table 1 shows various along-track resolutions obtainable at different radar frequencies.

TABLE 1

Achievable Resolutions

| Freq. (GHz) | Alt. (FT) | Range Res. (IN) | Along Track Res. (IN) | Cross Track Res. (IN)* |
|---|---|---|---|---|
| 1 | 40 | 4.5 | 3 | 4.5 |
| 1 | 80 | 4.5 | 3 | 9.0 |
| 3 | 40 | 1.5 | 1.5 | 1.5 |
| 3 | 80 | 1.5 | 1.5 | 3.0 |
| 9 | 80 | 1 | 1 | 1 |
| 9 | 240 | 1 | 1 | 3 |

*Cross track resolution is given in Table 1 for D = 40 ft.

Cross-track resolution is determined by the array aperture size, i.e., based on width D of antenna array 24 and is given by:

$\Delta y = h\lambda/2D$ where $\Delta y$=Cross-track resolution, h=Height of aircraft, D=Width of antenna array, and $\lambda$=Wavelength.

Table 1 above shows cross-track resolutions for a 40 foot wide antenna array at various altitudes and radar frequencies. During three-dimensional image processing, a processor 32 on board aircraft 30 receives a signal over connection 34 from receiving array 24. Processor 32 then generates a three-dimensional image which may be stored in a memory 36 also located aboard aircraft 30. Further, processor 32 may also be used to determine the identity of an object corresponding to the image. For example, the three-dimensional image generated by processor 32 may be compared to a previously stored image of a mine in an attempt to determine whether the received image is that of the mine.

Alternatively, an off-board processor 40 can be used to produce the three-dimensional image and may be able to identify objects corresponding to the received images thereof. Processor 32 transmits data via data link formed by antennas 42 to off-board processor 40. Further, off-board processor 40 can generate the image for viewing on an associated display 44.

Radar system 10 allows for the mapping of a subsurface minefield by detecting a three-dimensional section of the minefield layout. Such three-dimensional resolution imaging provides advantages not possible with conventional two-dimensional surface SAR, including the ability to obtain depth information and to provide classification of mines according to shape. In addition, radar system 10 provides radar cross-section (RCS) detection and identification of the interior metal components of plastic mines. Further, the radar system 10 enables the rejection of ground surface reflections,through polarization diversity.

An example of a preferred implementation of radar system 10 will now be considered. It will be understood that this example is provided to enhance understanding of the present Invention and not to limit the scope or adaptability thereof.

The necessary calculation to determine power requirements for a three-dimensional SAR in a ground penetrating mode of the present invention is provided by the formula:

$$P_T = \frac{SNR(4\pi)^3 h^4 kTLN_F L_{ref} A}{\tau G_T G_R \sigma \lambda^2}$$

where

SNR=signal to noise ratio per pulse (frequency) from receive array=10 dB h=height=80 ft k=Boltzmann Constant=$1.38\times10^{-23}$ J/K T=antenna noise temperature=400K L=system losses=10 dB $N_f$=receive noise figure=7 dB $L_{ref}$=reflection loss at earth's surface=10 dB A=earth attenuation=10 dB $\tau$=pulse width=0.5 $\mu$s $G_T$=transmit gain=15.8 dB $G_R$=receive gain=32.2 dB $\sigma$=Radar cross section=0.01 $m^2$ $\lambda$=0.1 m (Frequency=3 GHz)

$P_{peak}$=61.0 mW $P_{av}$=9.5 mW for duty factor 0.155

In this example, the radar transmitter 12 operates at S-band. Ground attenuation and reflection loss from surface 16 are factored in when considering the necessary power requirement. The typical peak and average transmit power requirements are in the milliwatt range.

In this example, the target volume, i.e., the three-dimensional target swath, is 1 nautical mile×320 feet×1 foot deep. The on-board processor 32 comprises a 1 gigahertz Pentium PC with a 20 gigabyte storage memory device 38. If all data collected from the three-dimensional swath is transmitted in real-time to an off-board processor, a data link of 5.4 MBPS is provided. One example of an applicable datalink is the high bandwidth data link (CHBDL) which is used by the U.S. Navy and which has a capacity of 274 MBPS. If all the data is stored on-board aircraft 30, and then transferred off-board for processing after the aircraft lands, the on-board storage memory requirement is about 0.4 gigabytes.

In order to effectively discriminate between mines and other debris such as rocks and roots, the present radar system operates at high frequencies. However, at such high frequencies, ground attenuation increases dramatically as the radar frequency increases. Therefore, it is preferable to select a desired frequency by factoring in ground attenuation when maximizing image resolution.

A second area of concern is that the reflection from the surface 16 will disrupt three-dimensional imaging. The reflection produces a large return which must be range-gated out in order for the smaller return radar signal from the buried mine or other target to be discernable. Therefore, it is advantageous for processor 32 to provide range gating.

In a test of the range gateout functions of the present radar system, a small metal plate was buried in a bucket of moist sand which was illuminated with an impulse-modulated X-band radar. It was determined that the surface of reflection could be ranged out by an on-board processor 32 and/or off-board processor 40. The soil attenuation at X-band was measured and found to be 114 dB/m. A 114 dB/m attenuation is within an acceptable range for a three-dimensional SAR imaging system. Therefore, land mines buried up to one foot in depth may be readily detected from an aircraft flown above a target area using the present system's three-dimensional SAR.

As discussed above, prior to the present invention, no other SAR system operated in high frequencies such as S-band and X-band as it was believed that ground attenuation would be too severe. However, the inventors have determined that attenuation effects at S-band and X-band were acceptable when using the present system for mines buried at shallow depths. Further, the high frequencies used by the present invention permit the fine resolution necessary for mine classification.

In addition to detecting mines, the present system may be adapted for use in detecting other objects buried near the surface of the ground. Further, the present system can be used to detect objects beneath the surface of fresh water. Other uses of the present invention include archeological exploration at the surface, detection of buried bunkers, and walls and the detection of buried persons.

Although the invention has been described above in relation to preferred embodiments thereof, it will be understood by those skilled in the art that variations and modifications can be effected in these preferred embodiments without departing from the scope and spirit of the invention.

What is claimed is:

1. A radar system comprising:

an aircraft for detecting buried objects from the air, for overflying a target area of interest;

a radar transmitter, carried by the aircraft, for producing a pulsed radar signal having a carrier frequency of at least three gigahertz;

an array of radar receiving antennas, carried by the aircraft for receiving a reflected signal produced by reflection of said radar signal and forming a real aperture for cross track resolution of the objects; and a processor for generating a three-dimensional image of said object from the reflected signal.

2. The radar system of claim 1, wherein the radar signal carrier frequency is within a range of three to ten gigahertz.

3. The radar system of claim 1, wherein said processor performs synthetic aperture beam processing based on movement of said radar transmitter and said antenna array relative to the target.

4. The radar system of claim 1, wherein said radar transmitter comprises a frequency-stepped pulse compression radar unit.

5. The radar system of claim 1, wherein said radar transmitter comprises an impulse-modulated radar unit.

6. The radar system of claim 1, wherein said aircraft includes wings and said array is disposed along said wings.

7. The radar system of claim 6, further comprising at least one boom extending laterally outwardly from one of said aircraft wings, wherein the array includes radar receiving antennas disposed along the boom.

8. The radar system of claim 6, wherein said aircraft further comprises first and second booms each extending laterally outwardly from one of said aircraft wings, and said array includes radar receiving antennas disposed along each of said booms.

9. The radar system of claim 8, wherein said booms comprise extendable booms.

10. The radar system of claim 1, wherein the signal processor filters out a portion of the reflected signal corresponding to reflection from the surface of the target area.

11. The radar system of claim 10, wherein the signal processor filters out a portion of the reflected signal corresponding to reflection from the earth's surface by range-gating.

12. The radar system of claim 1, wherein said processor comprises an on-board processor disposed on the aircraft.

13. The radar system of claim 1, wherein the processor comprises an off-board processor.

14. The radar system of claim 1, wherein the carrier frequency signal is frequency modulated or phase modulated.

15. The radar system of claim 1, wherein the carrier frequency signal is frequency modulated.

16. The radar system of claim 1, wherein the carrier frequency signal is greater than ten gigahertz.

17. A method for detecting a subsurface object in a target area from an aircraft, said method comprising:

transmitting a pulsed radar signal having a carrier frequency of at least three gigahertz using a radar transmitter disposed on the aircraft;

receiving a return of the transmitted signal reflected by the subsurface object with an array of radar receiving antennas disposed on the aircraft, said array forming a real aperture for cross-track resolution; and generating a three-dimensional image of said subsurface object based on the received return of the transmitted signal.

18. The method of claim 17, wherein the radar signal frequency is within a range of three to ten gigahertz.

19. The method of claim 17, further comprising the step of identifying the object from the three-dimensional image.

20. The method of claim 19, wherein the step of identifying the object comprises the step of comparing the generated three-dimensional image to a stored image.

21. The method of claim 20, wherein the stored image comprises an image identifiable as a mine.

22. The method of claim 20, wherein the stored image comprises an image identifiable as a mine, munition, or other object of interest.

23. The method of claim 17, wherein the step of transmitting a radar signal comprises selecting a desired transmitting frequency to maximize image resolution.

24. The method of claim 17, further comprising a step of filtering out portions of the return signal corresponding to reflection of the target area surface.

25. The method of claim 17, wherein the carrier frequency signal is greater than ten gigahertz.

26. The method of claim 17, wherein the step of transmitting a pulsed radar signal comprises using a plurality of radar transmitters spaced transversely on the aircraft to transmit a plurality of pulsed radar signals.

27. A method according to claim 17, wherein said transmitter and said receivers have an altitude between about forty feet and about two hundred forty feet during said transmitting and said receiving.

28. A radar system for detecting buried objects from an aircraft overflying a target area of interest, the system comprising:

a radar transmitter being carried by the aircraft, the radar transmitter producing a pulsed radar signal having a carrier frequency of at least three gigahertz;

an array of radar receiving antennas being carried by the aircraft for receiving a reflected signal produced by reflection of said radar signal and forming real aperture for cross-track resolution of the objects; and a processor for generating a three-dimensional image of said buried object from the reflected signal.

29. A radar system according to claim 28, wherein said array comprises at least three radar receivers.

30. A radar system according to claim 28, wherein said array is densely populated.

31. A radar system according to claim 28, wherein the array receivers have a half wavelength spacing.

32. A radar system according to claim 28, wherein said receiver array has a gain of about 32 dB.

* * * * *

UNITED STATES PATENT AND TRADEMARK OFFICE

CERTIFICATE OF CORRECTION

PATENT NO. : 6,982,666 B2
DATED : January 3, 2006
INVENTOR(S) : Temes et al.

It is certified that error appears in the above-identified patent and that said Letters Patent is hereby corrected as shown below:

Title page,
Item [74], *Attorney, Agent or Firm*, should read -- John J. Karasek, Sally A. Ferrett --.

Signed and Sealed this

Seventh Day of March, 2006

JON W. DUDAS
*Director of the United States Patent and Trademark Office*